US006837203B2

(12) United States Patent
Burger et al.

(10) Patent No.: US 6,837,203 B2
(45) Date of Patent: Jan. 4, 2005

(54) AUTOMATIC DECOMPRESSION DEVICE FOR VALVE-CONTROLLED INTERNAL COMBUSTION ENGINES

(75) Inventors: Wolf Burger, Boeblingen (DE); Jan Schempp, Sinzing (DE); Thomas Schaal, Tamm (DE)

(73) Assignee: MTD Products Inc, Valley City, OH (US)

( * ) Notice: Subject to any disclaimer, the term of this patent is extended or adjusted under 35 U.S.C. 154(b) by 0 days.

(21) Appl. No.: 10/440,823

(22) Filed: May 19, 2003

(65) Prior Publication Data

US 2004/0094110 A1 May 20, 2004

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | |
|---|---|---|---|
| 1,377,139 | A | 5/1921 | Murphy |
| 2,023,048 | A | 12/1935 | Gentili |
| 2,742,380 | A | 4/1956 | Peters |
| 3,314,408 | A | 4/1967 | Fenton |
| 3,330,263 | A | 7/1967 | Weglage et al. |
| 3,343,525 | A | 9/1967 | Weglage et al. |
| 3,381,676 | A | 5/1968 | Campen |
| 3,417,740 | A | 12/1968 | Perlewitz |
| 3,538,899 | A | 11/1970 | Burkett |
| 3,687,124 | A | 8/1972 | Kolorz |
| 3,981,289 | A | 9/1976 | Harkness |
| 4,084,568 | A | 4/1978 | Santo et al. |
| 4,184,468 | A | 1/1980 | Freyn |
| 4,252,092 | A | 2/1981 | Kaufman et al. |
| 4,312,308 | A | 1/1982 | Slattery |
| 4,338,893 | A | 7/1982 | Pomfret et al. |
| 4,394,851 | A | 7/1983 | Greier et al. |
| 4,414,933 | A | 11/1983 | Pribnow |
| 4,453,507 | A | 6/1984 | Braun et al. |
| 4,590,905 | A | 5/1986 | Matsuki et al. |
| 4,610,227 | A | 9/1986 | Nakano et al. |
| 4,615,312 | A | 10/1986 | Tsumiyama |
| 4,615,313 | A | 10/1986 | Tsumiyama |
| 4,619,228 | A | 10/1986 | Liu |
| 4,648,362 | A | 3/1987 | Kastlunger |
| 4,672,930 | A | 6/1987 | Sumi |
| 4,791,892 | A | 12/1988 | Hall |
| 4,977,868 | A | 12/1990 | Holschuh |
| 4,993,372 | A | 2/1991 | Mott et al. |
| 5,054,441 | A | 10/1991 | Nakatani et al. |
| 5,085,184 | A | 2/1992 | Yamada et al. |
| 5,116,287 | A | 5/1992 | Hironaka et al. |
| 5,150,674 | A | 9/1992 | Gracyalny |
| 5,184,586 | A | 2/1993 | Buchholz |
| 5,197,422 | A | 3/1993 | Oleksy et al. |

(List continued on next page.)

FOREIGN PATENT DOCUMENTS

| | | | |
|---|---|---|---|
| DE | 195 43 445 C1 | 2/1997 | |
| EP | 1 186 754 A2 | 3/2002 | |
| EP | 0 954 683 B1 | 4/2002 | |
| JP | 11-294130 | * 10/1999 | ..... F01L/13/08 |

*Primary Examiner*—Andrew M. Dolinar
(74) *Attorney, Agent, or Firm*—Wegman Hessler & Vanderbur

(57) ABSTRACT

The invention pertains to an automatic decompression device for valve-controlled internal combustion engines, having at least one camshaft for the actuation of gas shuttle valves and a decompression lever, which acts in cooperation with at least one gas shuttle valve and which is attached in a pivoting fashion on the camshaft on an axis of rotation, and which can be moved against a spring force from a first switch position into a second switch position as a result of the centrifugal forces acting on it during the revolution of the camshaft. It is suggested that the decompression lever be designed as a bow element the two ends of which are attached to the camshaft. The decompression arrangement is distinguished by a simple design, and is especially well-suited for small engines due to its lightweight construction.

14 Claims, 5 Drawing Sheets

U.S. PATENT DOCUMENTS

| | | | |
|---|---|---|---|
| 5,211,140 | A | 5/1993 | Hironaka et al. |
| 5,301,643 | A | 4/1994 | Garcyalny |
| 5,361,738 | A | 11/1994 | Iida |
| 5,375,570 | A | 12/1994 | Swain |
| 5,377,642 | A | 1/1995 | Morrow et al. |
| 5,379,734 | A | 1/1995 | Tsunoda et al. |
| 5,582,143 | A | 12/1996 | Stark et al. |
| 5,630,385 | A | 5/1997 | Taomo |
| 5,632,238 | A | 5/1997 | Furukawa et al. |
| 5,653,199 | A | 8/1997 | Ishiuchi et al. |
| 5,687,683 | A | 11/1997 | Knoblauch |
| 5,701,860 | A | 12/1997 | Horiuchi et al. |
| 5,799,635 | A | 9/1998 | Aljabari |
| 5,809,958 | A | 9/1998 | Gracyalny |
| 5,816,208 | A | 10/1998 | Kimura |
| 5,823,153 | A | 10/1998 | Santi et al. |
| 5,904,124 | A | 5/1999 | Poehlman et al. |
| 6,055,952 | A | 5/2000 | Gau |
| 6,073,599 | A | 6/2000 | Kimura |
| 6,223,708 | B1 | 5/2001 | Kampichler et al. |
| 6,240,888 | B1 | 6/2001 | Pilney |
| 6,250,271 | B1 | 6/2001 | Ikuma et al. |
| 6,253,723 | B1 | 7/2001 | Edlund et al. |
| 6,269,786 | B1 | 8/2001 | Snyder et al. |
| 6,343,579 | B1 | 2/2002 | Yasuyama et al. |
| 6,374,792 | B1 | 4/2002 | Suzuki et al. |
| 6,386,168 | B2 | 5/2002 | Suzuki et al. |
| 6,394,054 | B1 | 5/2002 | Rado et al. |
| 6,439,187 | B1 | 8/2002 | Dietz et al. |
| 6,454,037 | B1 | 9/2002 | Atsuumi et al. |
| 6,494,175 | B2 | 12/2002 | Gracyalny |
| 6,531,927 | B1 | 3/2003 | Chen |
| 6,536,393 | B2 | 3/2003 | Novak et al. |
| 6,539,906 | B2 | 4/2003 | Rado et al. |
| 6,543,403 | B2 | 4/2003 | Kawamoto |

* cited by examiner

AUTOMATIC DECOMPRESSION DEVICE FOR VALVE-CONTROLLED INTERNAL COMBUSTION ENGINES

This application claims priority to German Patent Application DE 102 53 231.1, entitled DECOMPRESSION LEVER UNIT, filed Nov. 15, 2002, which is incorporated herein by reference.

BACKGROUND OF THE INVENTION

A. Field of Invention

The invention pertains to an automatic decompression device for valve-controlled internal combustion engines.

B. Description of the Related Art

An automatic decompression device of this type is disclosed in DE 195 43 445 C1. For this purpose, attached in pivoting fashion on the camshaft is a decompression lever with its pivot axis arranged perpendicular to the axis of rotation of the camshaft. The decompression lever contains two lever arms, whereby the overall center of mass of the decompression lever is located on the axis of rotation or directly adjacent to it. The decompression lever is contacted by a spring element in such a way that below a certain rpm, the latter is held in a first switch position that acts in cooperation with the gas shuttle valve. In the first switch position, an automatic decompression is triggered by a corresponding actuation of the gas shuttle valve. Because of the centrifugal forces that are present, if a predetermined camshaft rpm is exceeded the decompression lever is pivoted against the spring force into a second switch position so that an effective connection no longer exists between the decompression lever and the gas shuttle valve, whereby the gas shuttle valve is now actuated solely by the action of the cam on the camshaft.

SUMMARY OF THE INVENTION

The invention permits the production of an automatic decompression device for valve-controlled internal combustion engines that is distinguished by a simple, lightweight design and is fastened or carried in such a way that cam and camshaft are not impaired in terms of their rigidity. In addition, the manufacturing process of the decompression device can be achieved in a few simple steps. By designing the decompression lever as a bow-shaped element that is carried on the camshaft at both ends of the bow, an automatic decompression arrangement is created, which, because of its lightweight construction and simple design, is especially suitable for small engines in which starting the engine primarily takes place by means of a pull-rope starter. Because of the lightweight design of the decompression bow element, which is made of spring steel wire, for example, no counterbalance weights are required on the decompression lever that are otherwise needed in order to place the overall center of mass of the decompression lever near the axis of rotation.

Additional advantages and advantageous developments of the invention are found in the subclaims and the description.

The extension required on the decompression lever to ensure that the tappet, which actuates the valve, is lifted in the base circle of the cam is simply configured as a bulge formed onto the bow element.

Attached to the camshaft to carry the bow element is a sleeve-like support element. The sleeve-like support element also seats the spring element that ensures that in a first switch position the decompression lever is pressed against the adjacent cam.

The support element contains two bore holes for seating the bow element. The support element also contains two guide grooves to guide each end of the bow element into the bore holes to ensure that the bow element is not deformed in the plastic region during assembly. Provided simultaneously on the support element are two elastic retaining pegs that together serve as a kind of locking hook for seating and securing the spring element, and, acting in cooperation with a leg of the spring element, as a moment support for the spring element.

Another advantage of the present invention is that the sleeve-like support element and the cam adjacent to the support element are designed as a one-piece plastic part that can be produced by means of injection molding.

An embodiment of the invention is explained in more detail in the following description and drawings.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
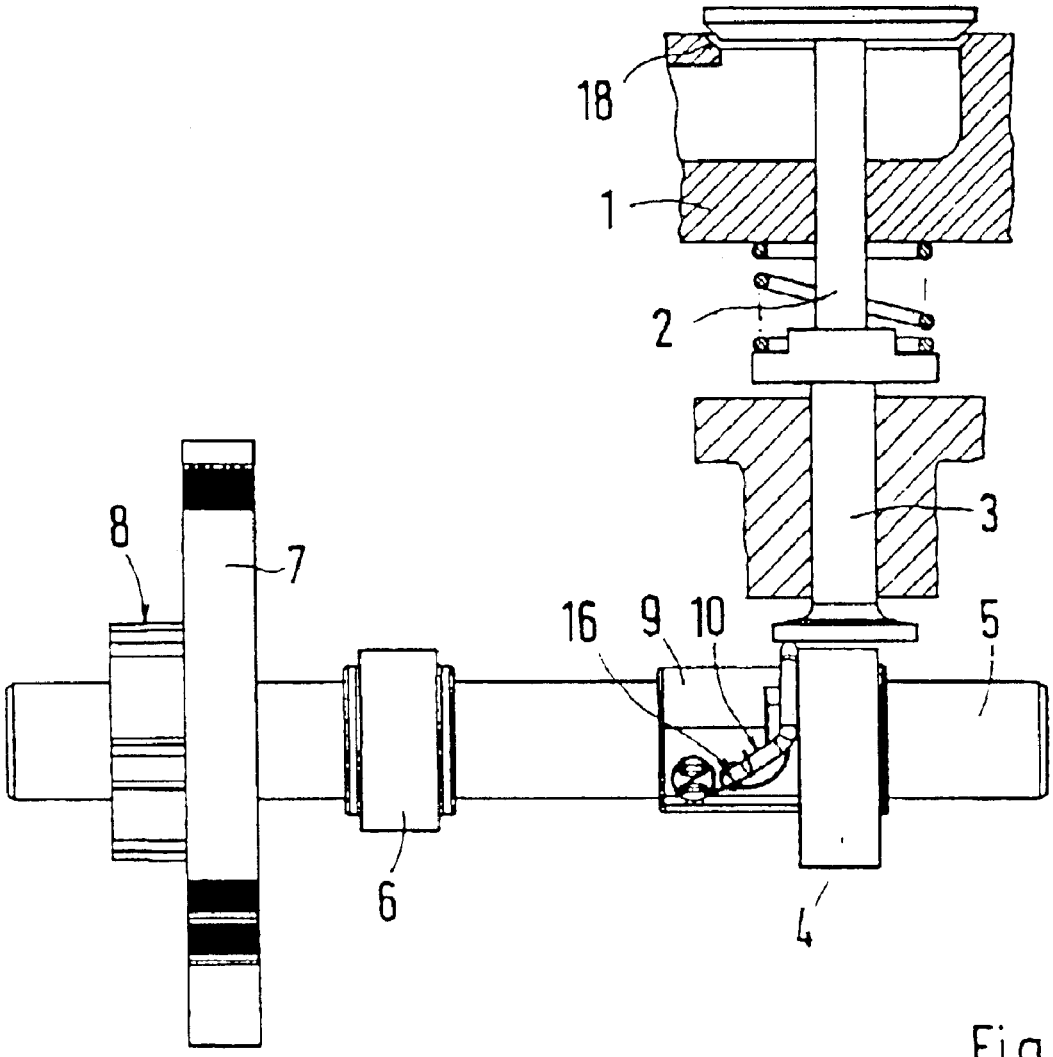
FIG. 1 shows a camshaft with decompression arrangement in a first switch position.
Figure 2:
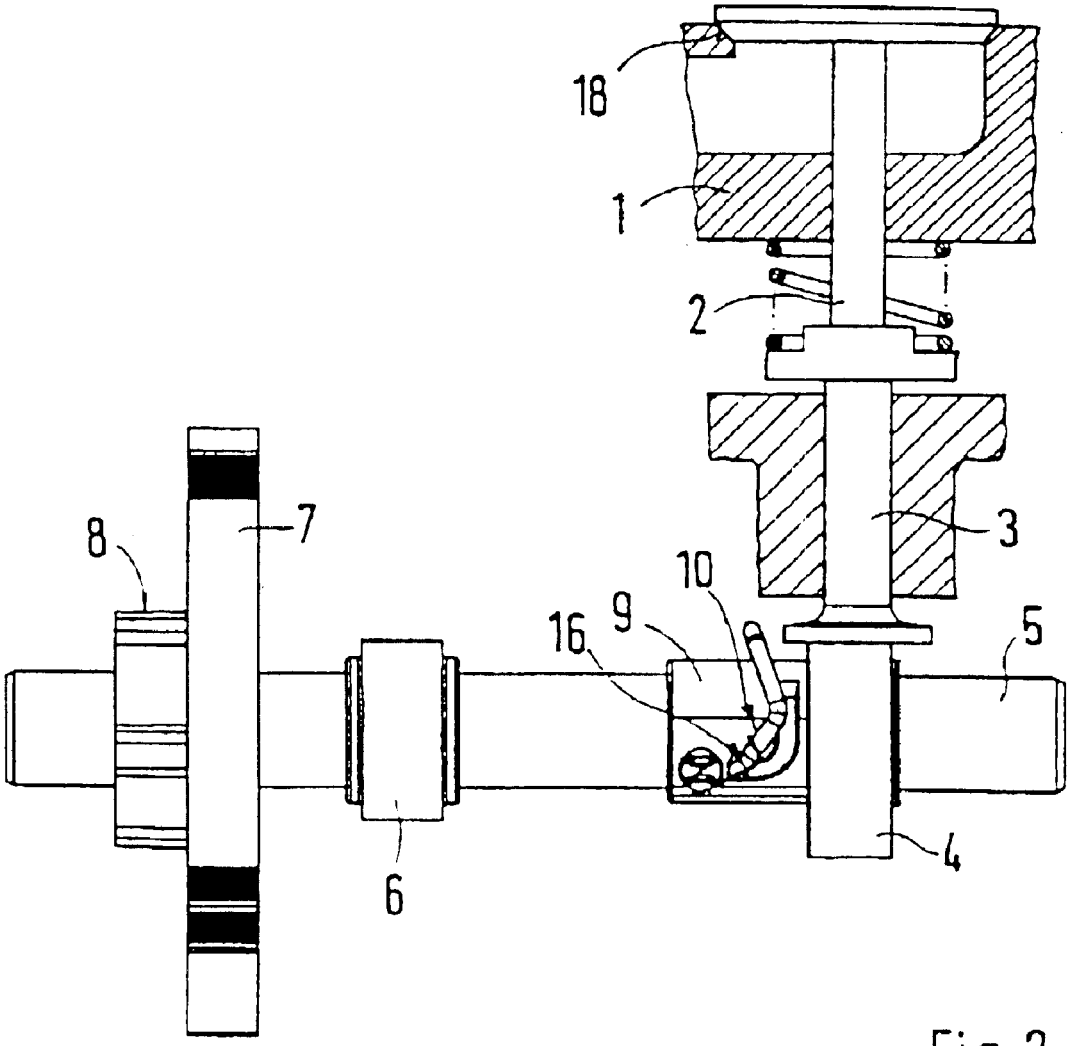
FIG. 2 shows a camshaft with decompression arrangement in a second switch position.
Figure 3:
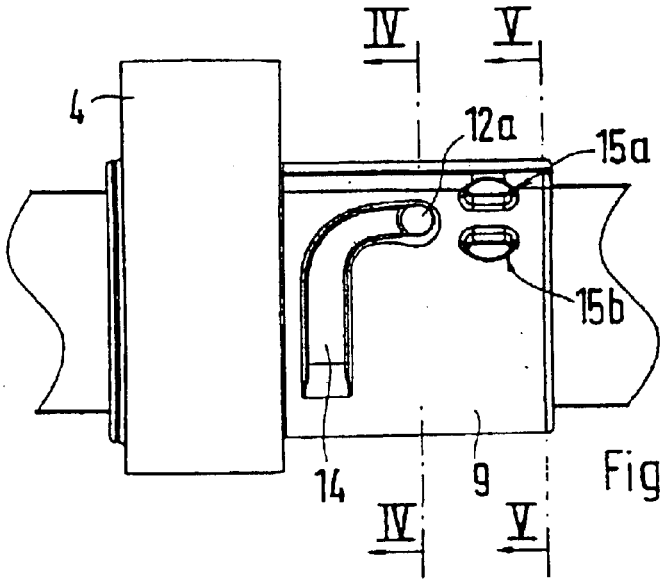
FIG. 3 shows an enlarged detail view of a part of the decompression arrangement.
Figure 4:
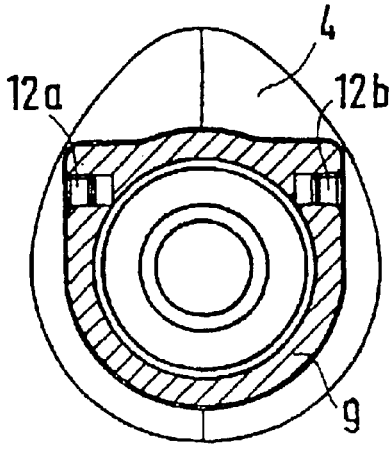
FIG. 4 is a cross-section of the present invention taken along the IV—IV in FIG. 3.
Figure 5:
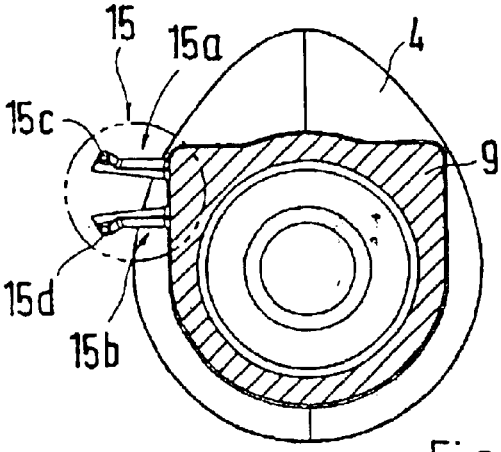
FIG. 5 is a cross-section of the present invention taken along the line V—V in FIG. 3.

Referring now to the drawings wherein the showings are for purposes of illustrating a preferred embodiment of the invention only and not for purposes of limiting the same. Referring to FIGS. 1 and 2, located in the cylinder head 1 of an internal combustion engine (not shown) is a gas shuttle valve 2 that is actuated, via a tappet 3, by the cam 4 of a camshaft 5 in a manner commonly known in the art. The camshaft 5 contains a second cam 6, which, in a manner identical to the cam 4, actuates a gas shuttle valve (not shown). Attached to the camshaft 5 is a driving gearwheel 7, by means of which the camshaft 5 is driven by a crankshaft (not shown). An externally toothed internal rotor 8 of an oil pressure pump (not shown) is located adjacent to the driving gearwheel 7.

Figure 6:
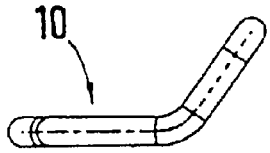
FIG. 6 shows a side view of the decompression lever.
Figure 7:
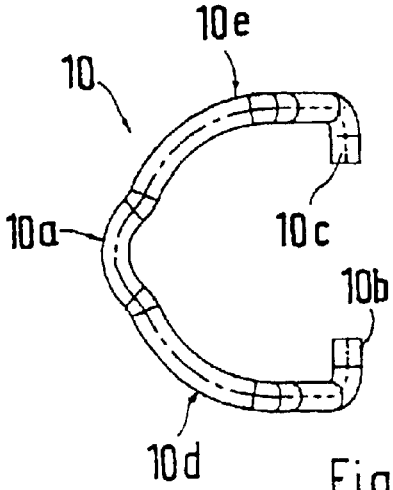
FIG. 7 shows a top view of the decompression lever.

Positioned adjacent to the cam 4 is a sleeve-like support element 9 whereby a decompression lever 10 is pivotally attached. The decompression lever is designed from steel spring wire and formed as a bow element 10 as shown in FIG. 6 and which when in a first position, as shown in FIG. 1, of its pivoting motion acts in cooperation with the tappet 3 or the gas shuttle valve 2 via a bulge 10*a* formed on the vertex. The support element 9 and cam 4 are formed in one piece as an injection molded part.

Referring to FIGS. 3–5 and 7, located on the support element 9 for pivotally attaching the decompression lever 10 are two bore holes 12*a* and 12*b*, in each of which an end 10*b* and 10*c* of a bow arm 10*d* and 10*e* of the bow element 10 engages. In assembling the bow element 10, as described below, the support element 9 contains two guide grooves 14 (only one shown) that lead to each bore hole 12*a* and 12*b* respectively. In addition, the support element 9 further contains a two-part peg element 15, whereby two elastic pegs 15*a* and 15*b* are attached for seating a spring element 16. At their ends, the two pegs 15*a* and 15*b* contain locking catches 15*c* and 15*d* that serve as a axial securing measure for the spring element 16.

Figure 8:
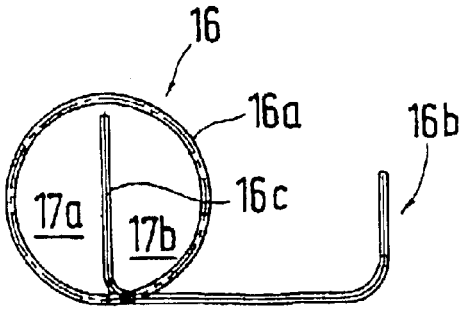
FIG. 8 shows a front view of the spring element of the decompression arrangement.
Figure 9:
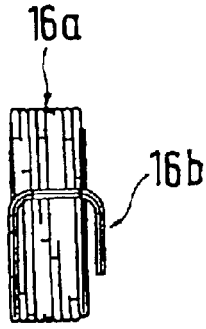
FIG. 9 is a side view of the spring element.
Figure 10:
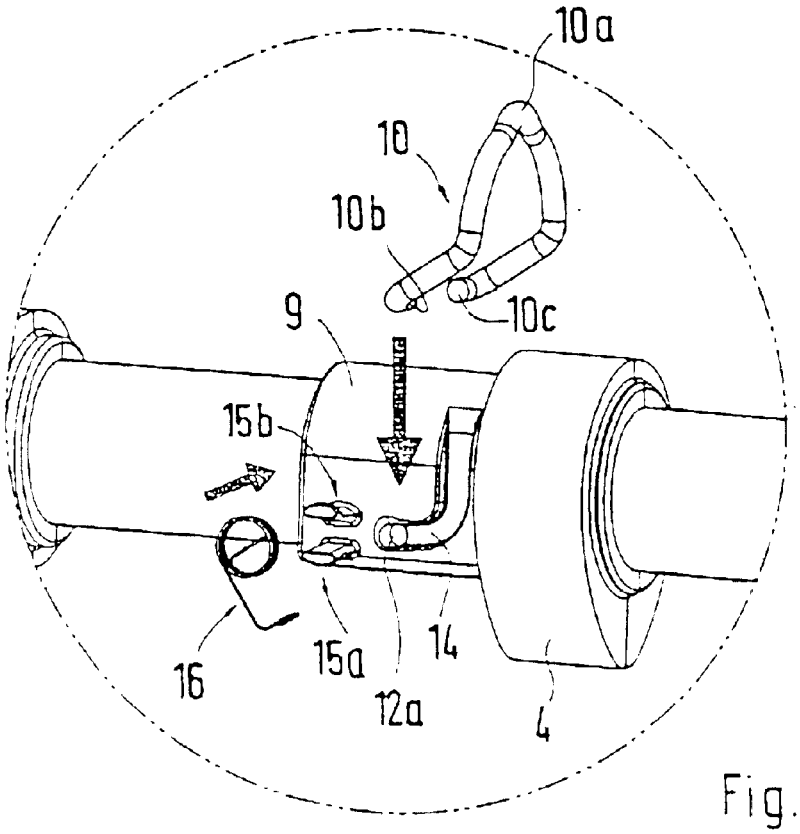
FIGS. 10–13 show detailed views of the present invention in various stages of assembly.
Figure 11:
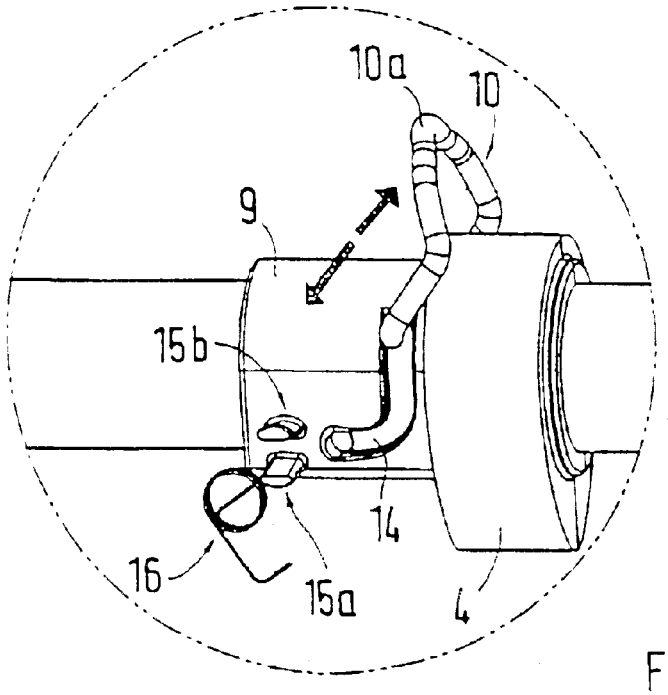
Figure 12:
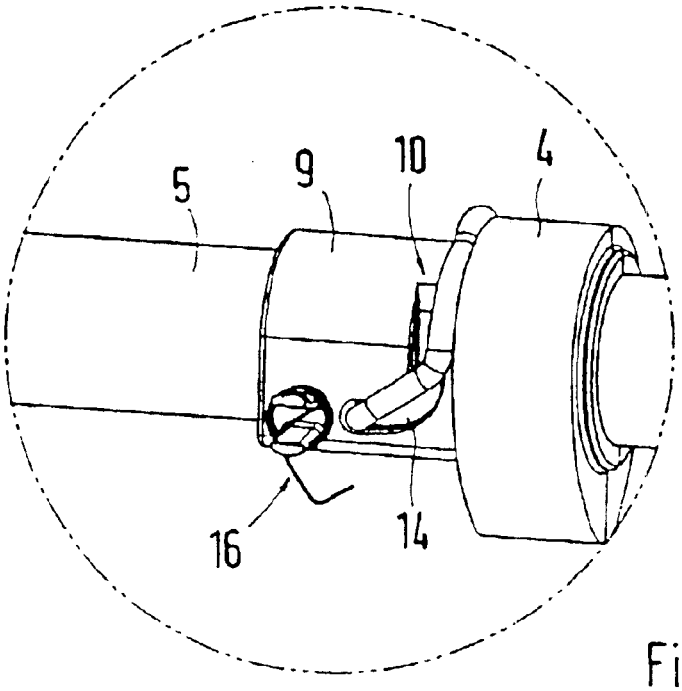
Figure 13:
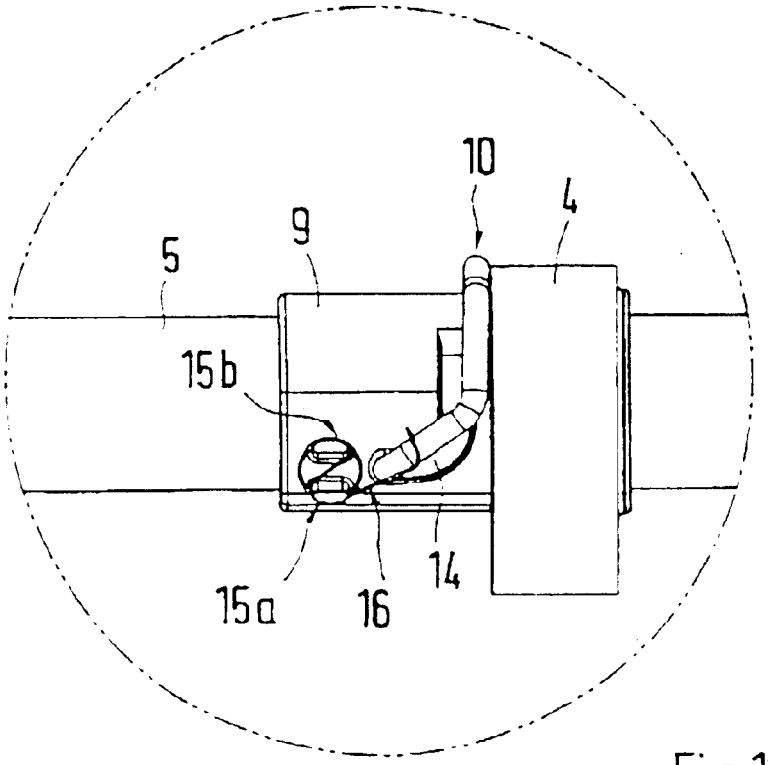

Referring to FIGS. 8 and 9, the spring element 16 is comprised of a circular and multilayered basic body 16*a* and a first spring end 16*b* whereby the U-shaped end segment encompasses the bow arm 10*d* in the assembled state. The second spring end 16*c* forms a straight line and in conjunction with the basic body 16*a*, forms two semicircular subspaces 17*a* and 17*b* into which the two pegs 15*a* and 15*b* engage in the assembled state. In addition, a moment support for the spring element 16 can be implemented by means of the two pegs 15*a* and 15*b* and the spring end 16*c* seated between the two pins.

Referring to FIGS. 10–13 the assembly of the decompression arrangement will be described in more detail. The two bow arms 10*d* and 10*e* of the decompression lever 10 are expanded elastically so that the two bow ends 10*b* and 10*c* can be directed into the guide grooves 14. The bow element 10 is pressed downward into the two guide grooves 14 until the two bow ends 10*b* and 10*c* latch into the two bore holes 12*a* and 12*b*. The bow element 10 is then pivoted towards the cam 4 so it comes to rest against it. The basic body 16*a* of the spring element 16 is pressed onto the two pegs 15*a* and 15*b* that together act as a locking hook, and the first spring end 16*b* is suspended by its U-shaped end segment from the bow arm 10*d*.

Referring to FIGS. 1 and 2, the dimensions of the bow element 10 are chosen in such a way that in a first switch position, the bulge 10*a* of the bow element 10 extends beyond the base circle of the cam 4, so that when the camshaft 5 rotates, the bow element 10 with its bulge 10*a* lifts the gas shuttle valve 2 from the valve seat 18 by means of the tappet 3. In a second switch position the bow element 10 is pivoted in such a way that the cup tappet 3 acts in cooperation with the base circle and the remaining segments of the cam 4 without the decompression lever 10 coming into contact with the cam 4.

Due to the rotation of the camshaft 5 when the internal combustion engine is in operation, centrifugal forces acting on the decompression lever 10 create on the decompression lever 10 a moment of torsion that is directed around the axis of rotation of the decompression lever 10 and that counteracts the force of the spring element 16. At a lower rpm (e.g., <600 rpm), the moment caused by the action of the spring element 16 is greater than the moment caused by the centrifugal forces, so that the decompression lever 10 is pressed into its first switch position as shown in FIG. 1. In this switch position, the decompression lever 10 acts, as previously indicated, together with the cup tappet 3. As the rpm of the camshaft 5 increases, the moment of torsion that is created by the centrifugal forces acting on the decompression lever 10 increases until it surpasses the moment of torsion caused by the action of the spring element 16. From this point on, the bow element 10 is pivoted, against the action of the spring element 16, away from the cam 4 and against a limit stop (not shown) so that the decompression is switched from on to off.

The suggested decompression arrangement is especially well-suited for small engines that are used, for example, in hand-operated lawn mowers or similar implements. If, for example, these engines are equipped with a pull-rope starter, the startup or starting operation can be made easier by the decompression arrangement.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. An automatic decompression device for valve-controlled internal combustion engines comprising:

a camshaft;

a gas shuttle valve, wherein the gas shuttle valve is actuated by the camshaft; and a decompression lever made of steel spring wire pivotally attached to the camshaft, wherein the decompression lever rotates against a spring force by switching from a first switch position to a second switch position by a centrifugal force due to the rotation of the camshaft, wherein the decompression lever comprises a resilient bow element containing two ends that are operatively attached to the camshaft.

2. The automatic decompression device of claim 1, wherein the bow element further comprises a bulge located at the vertex of the bow element.

3. An automatic decompression device for valve-controlled internal combustion engines comprising:

a camshaft;

a gas shuttle valve, wherein the gas shuttle valve is actuated by the camshaft;

a sleeve-like support element operatively attached to the camshaft; and a decompression lever pivotally attached to the camshaft, wherein the decompression lever rotates against a spring force by switching from a first switch position to a second switch position by a centrifugal force due to the rotation of the camshaft, wherein the decompression lever comprises a bow element containing a bulge located at the vertex of the bow element and two ends that are operatively attached to the sleeve-like support element.

4. The automatic decompression device of claim 3, wherein the sleeve-like support element further comprises: two bore holes to operatively attach the bow element; two guide grooves one each leading to a bore hole to facilitate the assembly of the bow element.

5. The automatic decompression device of claim 4, comprising a spring element and two elastic pegs operatively connected to the spring element, wherein the pegs serve for the seating, securing and moments support of the spring element.

6. The automatic decompression device of claim 5, wherein the sleeve-like support element and the cam are formed as an injection molded part.

7. The automatic decompression device of claim 3 wherein the decompression lever comprises a resilient bow element.

8. The automatic decompression device of claim 7 wherein the decompression lever is made of steel spring wire.

9. An automatic decompression device for valve-controlled internal combustion engines comprising:

a cam member having a pair of bore holes;

a gas shuttle valve, wherein the gas shuttle valve is actuated by the camshaft;

a spring element; and a decompression lever comprising a resilient bow-shaped member and having first and second ends, the decompression lever being pivotally mounted on the cam member by expanding the bow-shaped member so that said first and second ends are respectively inserted into one of the bore holes such that the decompression lever is povotably by a centrifugal force due to the rotation of the cam member against a force exerted thereon by said spring element from a first position to a second position.

10. The automatic decompression device of claim 9, wherein the cam member comprises a camshaft having a cam mounted thereon, said cam having a sleeve-like support element extending therefrom, the decompression lever being operatively attached to the sleeve-like support element.

11. The automatic decompression device of claim 10, wherein the sleeve-like support element contains the two bore holes for receiving the ends of the decompression lever.

12. The automatic decompression device of claim 11, wherein the sleeve-like support element has two guide grooves therein, each guide groove leading to a respective bore hole to facilitate engagement of the ends of the decompression lever with the bore holes.

13. The automatic decompression device of claim 12, wherein the sleeve-like support element further comprises tow pegs configured to receive the spring element, wherein the pegs serve for the seating, securing and moments support of the spring element.

14. The automatic decompression device of claim 10, wherein the sleeve-like support element and the cam are formed as an injection molded part.

* * * * *